US008435081B2

(12) United States Patent
Aase

(10) Patent No.: US 8,435,081 B2
(45) Date of Patent: May 7, 2013

(54) THIN PLUG ASSEMBLY AND METHODS FOR MAKING THE SAME

(75) Inventor: Jonathan Aase, Redwood City, CA (US)

(73) Assignee: Apple Inc., Cupertino, CA (US)

( * ) Notice: Subject to any disclaimer, the term of this patent is extended or adjusted under 35 U.S.C. 154(b) by 162 days.

(21) Appl. No.: 13/077,027

(22) Filed: Mar. 31, 2011

(65) Prior Publication Data

US 2011/0243360 A1 Oct. 6, 2011

Related U.S. Application Data

(60) Provisional application No. 61/319,772, filed on Mar. 31, 2010, provisional application No. 61/384,097, filed on Sep. 17, 2010, provisional application No. 61/326,102, filed on Apr. 20, 2010.

(51) Int. Cl.
*H01R 24/00* (2011.01)

(52) U.S. Cl.
USPC ..... 439/669

(58) Field of Classification Search ..... 439/668, 439/669
See application file for complete search history.

(56) References Cited

U.S. PATENT DOCUMENTS

| | | | | |
|---|---|---|---|---|
| 8,162,697 | B1 * | 4/2012 | Menolotto et al. | 439/669 |
| 8,206,181 | B2 * | 6/2012 | Steijner | 439/669 |
| 8,235,756 | B2 * | 8/2012 | Stiehl | 439/669 |
| 8,267,727 | B2 * | 9/2012 | Lynch et al. | 439/669 |
| 8,287,315 | B2 * | 10/2012 | Montena | 439/669 |

* cited by examiner

*Primary Examiner* — Khiem Nguyen
(74) *Attorney, Agent, or Firm* — Kilpatrick Townsend & Stockton LLP

(57) ABSTRACT

Thin plug assemblies and methods for constructing the same are disclosed. The plug assembly can include a plug portion, a cable portion, and an interfacing portion between the plug portion and the cable portion. The plug portion can include several conductive regions each connected to a conductor of the cable portion to form conductor/plug member coupling (s), for example via a plug extension member associated with each conductive region. The plug assembly is constructed such that a diameter of the plug portion, interface portion, and at least part of the cable portion have substantially the same diameter. Ring structures enhance one or more of the conductor/plug member couplings by providing a press or interference fit directly to the coupling(s). Ring structures are constructed to slide axially over at least one conductor and at least one plug member.

10 Claims, 6 Drawing Sheets

THIN PLUG ASSEMBLY AND METHODS FOR MAKING THE SAME

CROSS-REFERENCE TO RELATED APPLICATION

This application claims the benefit of previously filed U.S. Provisional Patent Application No. 61/319,772, filed Mar. 31, 2010, entitled "Thin Audio Plug and Coaxial Routing of Wires," U.S. Provisional Patent Application No. 61/384,097, filed Sep. 17, 2010, entitled "Cable Structures and Systems Including Super-Elastic Rods and Methods for Making the Same," U.S. Provisional Patent Application No. 61/326,102, filed Apr. 20, 2010, entitled "Audio Plug with Core Structural Member and Conductive Rings." Each of these provisional applications is incorporated by reference herein in their entireties.

BACKGROUND OF THE INVENTION

Connectors are commonly used to connect one electronic device to another electronic device or an accessory such as a headset. These connectors exist in all sorts of different configurations and enable passage of data and/or power. Examples of such connectors include USB connectors, Firewire connectors, audio plugs, video plugs, headset plugs, optical plugs, and magnetic connectors.

The connector typically interfaces with one or more conductors in an interfacing region that can be covered with an overmold or a protective jacket. The overmold can reinforce the physical coupling of the conductor(s) and connector, and provide strain relief. The overmold is sized to have dimensions that are greater than the dimensions of the connector because it covers a portion of the connector. This can create a visible and tactile discontinuity (e.g., a step change) between the outer surface of the connector and overmold that can be regarded as a cosmetic blemish. Accordingly, connectors are needed that have more aesthetically pleasing overmolds.

SUMMARY OF THE INVENTION

Thin plug assemblies and methods for constructing the same are disclosed. The plug assembly can include a plug portion, a cable portion, and an interfacing portion between the plug portion and the cable portion. It will be understood that the term plug can encompass any suitable type of connector. The plug portion can include several conductive regions each connected to a conductor of the cable portion. The conductive regions can be isolated from each other using dielectric rings. One or more of the conductive regions can each be associated with a plug extension member extending towards the cable portion. Individual conductors can be coupled to the plug extension members to establish a path for transferring data and/or power to the conductive regions.

The plug assembly is constructed such that a diameter of the plug portion, interface portion, and at least part of the cable portion have substantially the same diameter. In other words, the plug assembly is constructed such that the diameter of the interfacing portion is no larger than the diameter of the plug portion. For example, if conductive regions of the plug portion are the 3.5 mm in diameter, the interface portion can have a diameter that is substantially the same. This provides for a plug assembly having a seamless and/or stepless transition from the plug portion to the cable portion. As a result, no part of the interfacing portion enshrouds or encompasses the plug portion in a manner that would result in a diameter that exceeds the diameter of the plug portion. Any potential for reduced reliability of the conductor/plug member couplings (due to use of such an interface portion) is mitigated through the use of ring structures according to embodiments of the invention.

Ring structures enhance one or more of the conductor/plug member couplings by providing a press or interference fit directly to the coupling(s). Ring structures are constructed to slide axially over at least one conductor and at least one plug member. As the ring is slid into position, it engages the conductor and plug extension member to provide an additional retaining force to that conductor/plug member coupling or interface.

BRIEF DESCRIPTION OF THE DRAWINGS

The above and other features of the present invention, its nature and various advantages will be more apparent upon consideration of the following detailed description, taken in conjunction with the accompanying drawings in which.

DETAILED DESCRIPTION

Figure 1:
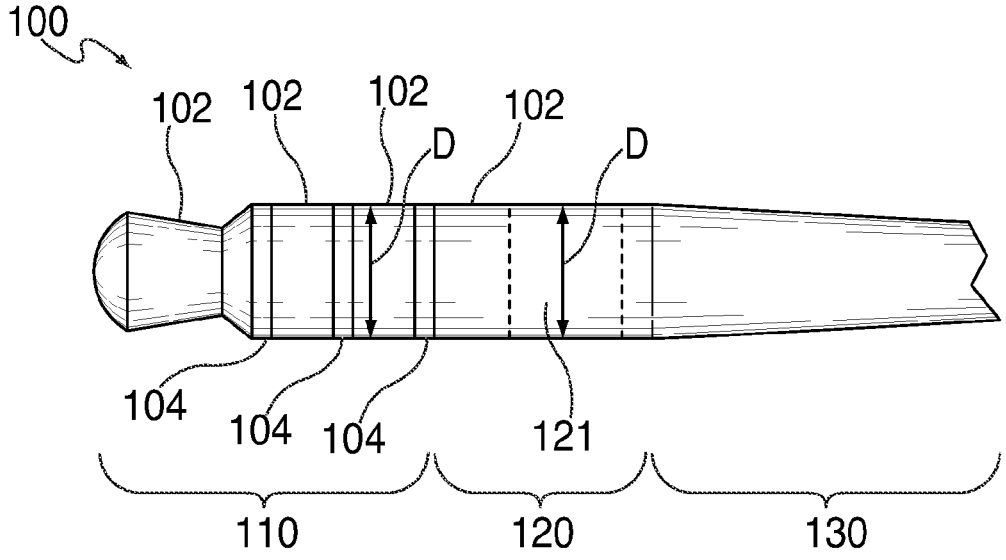
FIG. 1 shows an illustrative plug assembly 100 constructed in accordance with some embodiments of the invention

FIG. 1 shows an illustrative plug assembly 100 constructed in accordance with some embodiments of the invention. Plug assembly 100 is a tip, ring, sleeve ("TRS") type of connector that has a cylindrical shape of a predetermined diameter and has two or more contacts. TRS type connectors can be manufactured with two, three, four, five or six contacts and typically have a diameter of 3.5 mm or 2.5 mm. Audio plugs can have three contacts (e.g., left channel, right channel, and ground) and Audio/Microphone or Audio/Video plugs can have four contacts (e.g., left channel, right channel, mic or video, and ground). TRS type plugs are sometimes referred to as audio jacks, audio plugs, phone jacks, phone plugs, jack plugs, stereo plugs, mini-stereo, mini-jacks, and headset plugs. In use, plug assembly 100 is inserted into a jacket, which may be contained in an electronic device such as a phone, computer, or media player.

Plug assembly 100 can have plug portion 110, interfacing portion 120, and cable portion 130 arranged in the manner shown, and the diameters of plug portion 110 and interfacing portion 120 can be substantially the same, as indicated by the diameter designation, D, in FIG. 1. Plug portion 100 can include conductive regions 102, which are electrically isolated by dielectric rings 104. Interfacing portion 120 is the region of plug assembly 100 where conductors (not shown) of cable portion 130 are coupled to plug extension members (not shown) of plug portion 100. Each plug extension member is electrically coupled to a particular one of conductive regions 102. Cable portion 130 can include any number of conductors and that number may equal the number of conductive regions 102 in plug region 110.

Interfacing portion 120 can include shell member 121 that covers the plug extension members (not shown) and the portions of the conductors coupled thereto and fits flush against plug portion 110. In some embodiments, shell member 121 can be part of cable portion 130 or it may be a component manufactured independent of cable portion 130. The flush fit (of interface portion 120) provides a seamless and continuous union of plug portion 110 and cable portion 130. That is, there is substantially no visible or tactile step change in the diameters of plug portion 110 and interfacing portion 120. This can be accomplished using ring structures and/or spring arms according to embodiments of the invention.

Figure 2:
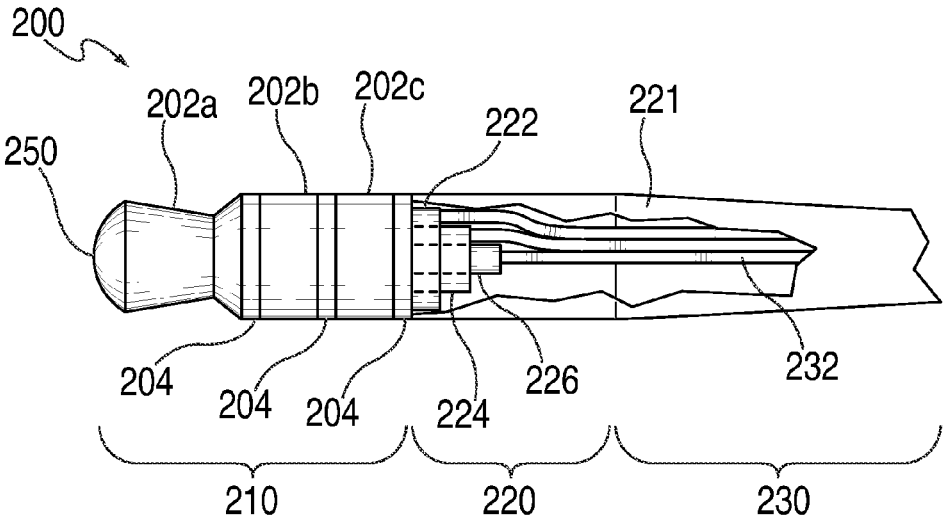
FIG. 2 is a partial sectional view of a plug assembly showing an interface between conductors in accordance with some embodiments of the invention.

FIG. 2 is a partial sectional view of a plug assembly showing an interface between conductors in accordance with some embodiments of the invention. Plug assembly 200 can include plug portion 210, interfacing portion 220, and cable portion 230 having some or all of the features described above in connection with plug assembly 100 (FIG. 1). Cable portion 230 can include individual conductors 232 each coupled to a conductive region 202*a*, 202*b*, and 202*c* within interfacing portion 220. In particular, individual conductors 232 can each be coupled to one of plug extension members 222, 224, and 226. Plug extension members 222, 224, and 226 can extend away from plug portion 210 towards cable portion 230. So that the interface between the plug extension members and the conductors does not interfere with conductive regions 204, the plug extension members can be extend beyond a surface of conductive region 202*c* that is nearest cable portion 230 (e.g., the surface of conductive regions 202*a*, 202*b*, and 202*c* that is furthest from tip 250 of plug portion 210).

Each of plug extension members 222, 224, and 226 can be coupled to a conductive region 202. For example, conductive region 202*c* (e.g., the conductive region that is closest to interfacing portion 220) can be coupled to plug extension member 222, or be constructed with an integrated plug extension member 222. Middle conductive region 202*b* can be coupled to or include plug extension member 224, and conductive region 202*a* (e.g., the conductive region that forms tip 250 of plug assembly 200, and that is farthest from interfacing portion 220) can be coupled to or include plug extension member 226. In some embodiments, plug assembly 200 can include additional conductive regions than those shown in FIG. 2 and each of those additional conductive regions can have a corresponding plug extension member.

The plug extension members can have any configuration relative to each other to ensure that a conductor can be coupled to each plug extension member. In particular, at least a portion of each plug extension member may include an exposed contact pad to which a conductor can be coupled. For example, a conductor can be soldered to an exposed contact pad, or can be coupled using a surface mount technology process. In some cases, the plug extension members can be staggered or stepped relative to each other such that side walls of one or more plug extension members are exposed (e.g., such that the plug extension members have the appearance of a stepped tower). This may provide a larger surface area to which conductors can be coupled.

Different approaches can be used to provide staggered or stepped plug extension members. In some cases, each plug extension member can include an opening or hole sized to allow all taller plug extension members to pass through (e.g., plug extension member 222 includes an opening for receiving plug extension members 224 and 226, and plug extension member 224 includes an opening for receiving plug extension member 226). In some cases, a plug extension member can include several distinct holes or openings, where different taller plug extension members can pass through each hole. For example, plug extension member 222 can include a first hole for plug extension member 224 and a second hole for plug extension member 226, and plug extension member 224 can include a single hole for plug extension member 226, where the hole of plug extension member 224 and the second hole of plug extension member 222 are aligned to receive plug extension member 226.

To ensure that data or power transmitted through a particular conductive region 202 does not interfere with data or power transmitted through other conductive regions 202, dielectric rings 204 provided between conductive regions 202 can also be provided between plug extension members 222, 224, and 226. For example, the material used to isolate adjacent conductive regions can extend within plug portion 210 towards interfacing portion 220 to isolate the plug extension members corresponding to each of the conductive regions.

During use, a user may apply forces to plug assembly 200 that tend to deform or damage the interface between conductors 232 and one or more of plug extension members 222, 224, and 226. For example, a user may pull at cable portion 230 to remove plug assembly 200 from a device. To strengthen the interface between the conductors and plug portion 210, interfacing portion 220 can include shell member 221 to support conductors 232 and enclose the interface. For example, shell member 221 can include a molded component that adheres to conductors 232 and to plug extension members 222, 224, and 226. If the dimensions of shell member 221 are constricted such that the outer diameter of shell member 221 is substantially the same as the diameter of plug portion 210, however, shell member 221 may provide insufficient support for the interface.

To add additional support, a ring can be press fit over the interface between the conductors and the plug extension members. In particular, the ring can be press fit around at least one conductor and at least plug extension member to reinforce the coupling between the conductor(s) and plug member(s). Because the plug extension members can have different sizes (e.g., different diameters, the ring can have a variable inner and/or outer diameter, for example to include a stepped inner diameter complementing the dimensions and distribution of the plug extension members.

Figure 3:
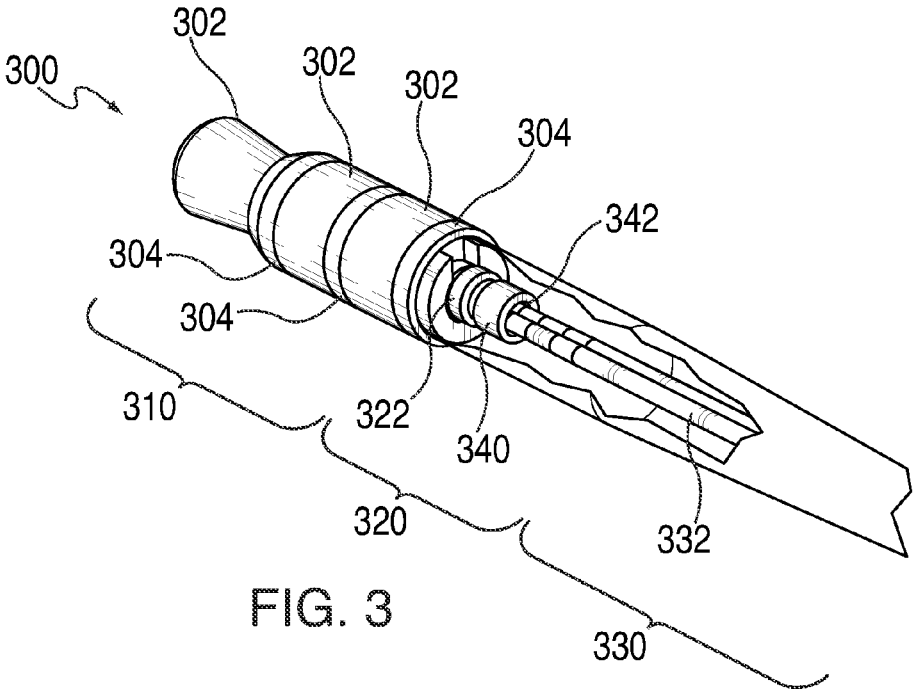
FIG. 3 is a perspective view of a plug assembly having a ring supporting an interface between a plug portion and conductors in accordance with some embodiments of the invention.

FIG. 3 is a perspective view of a plug assembly having a ring supporting an interface between a plug portion and conductors in accordance with some embodiments of the invention. Plug assembly 300 can include plug portion 310, interfacing portion 320, and cable portion 330 having some or all of the features of corresponding components described above. Conductive regions 302, separated by dielectric rings 304, can include plug extension members (e.g., member 322) connected to conductors 332.

To provide additional support to the interface between the conductors and the plug extension members, plug assembly 300 can include ring 340 positioned over the interface (e.g., over some or all of the contact pads or solder joints of the plug). Ring 340 can include opening 342 sized to receive at least conductors 332, such that ring 340 can be assembled by sliding ring 340 axially over conductors 332 towards a distal end (e.g., tip 250, FIG. 2) of plug assembly 310. In some cases, ring 340 can be inserted over conductors 332 prior to coupling conductors 332 to plug portion 310 (e.g., by inserting the ring over the distal end of conductors 332 that will be coupled to the plug extension members), or ring 340 can be provided over conductors 332 after the conductors have been coupled to the plug portion (e.g., insert ring 340 from the proximal end of conductors 332, and slide ring 340 over the entire length of the conductors).

The inner diameter of opening 342 can be selected relative to dimensions of one or more plug extension members, or relative to the position and size of contact pads on plug extension members (e.g., the distance of plug extension members from a centerline of plug assembly 300). In particular, ring 340 can be sized such that an inner surface of opening 342 comes into contact with at least one contact pad. Then, ring 340 can engage both a conductor and a plug extension member to secure the conductor and the plug extension member together.

Figure 4:
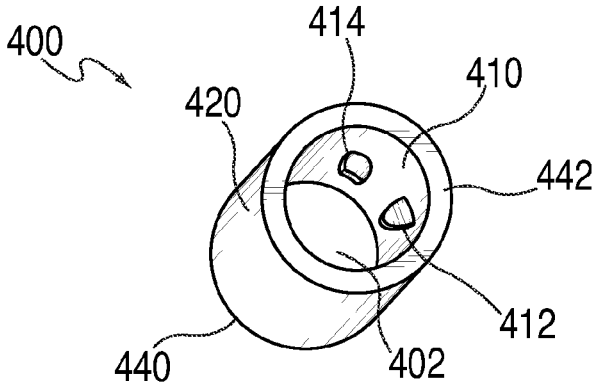
FIG. 4 is a schematic view of a ring in accordance with some embodiments of the invention.

In some cases, an inner surface of opening 342 may include a variable size or internal features (e.g., protrusions, bumps, tabs, indentations, or recesses). FIG. 4 is a schematic view of a ring in accordance with some embodiments of the invention. Ring 400 can include opening 402 defining inner surface 410, and outer surface 420. Inner surface 410 can include internal features 412 recessed relative to or extending past surface 410 such that different portions of the inner surface 410 can engage or come into contact with different contact pads or different interfaces between plug extension members and conductors. For example, inner surface 410 can engage portions of a plug extension member within an interfacing portion (e.g., interfacing portion 320, FIG. 3) that may be at different positions or distances relative to a centerline of the plug assembly, or relative to a plane perpendicular to the centerline such as a plane passing through a proximal surface of the contact region that is nearest the interfacing portion (e.g., the most proximal contact region). This may be beneficial, for example, when several plug extension members are stepped.

Alternatively, an inner surface 410 can include a recess or trench forming a channel within inner surface 410 (e.g., a channel forming an empty ring within ring 400). The channel can be positioned such that it is aligned with one or more contact pads of plug extension members. Other, non-channel portions of inner surface 410 can engage at least one plug extension member (e.g., distal portions 440 of inner surface 410), and other portions can engage one or more conductors (e.g., proximal portions 442 of inner surface 410). Using this approach, ring 400 may not come into contact with the joints between the plug extension members and the conductors, which may protect the interface from damage when ring 410 is positioned within the interfacing portion.

Ring 400 can be constructed from any suitable material. In some cases, ring 400 can be at least partially or entirely constructed from a non-conductive material to avoid shorting the different conductors or plug extension members. In particular, at least inner surface 410 (or other surfaces coming into contact with the plug extension members) can be coated with a non-conductive material. Such materials can include, for example, plastics, ceramic materials, organic materials, or combinations of these.

The material used for ring 400 can also be selected using structural criteria. In particular, the material of ring 400 may be selected to resist forces applied to the plug assembly. In some cases, ring 400 can be constructed such that portions that engage or come into contact with a conductor or a plug extension member are sufficiently hard or stiff to maintain the conductors coupled to the plug extension members.

Ring 400 can be secured within a plug assembly using any suitable approach. In some cases, ring 400 can be press fit over plug extension members. In such cases, inner surface 410 can be sized, or include features that create an interference fit. In some cases, ring 400 can be secured using an adhesive, tape, a fastener, a clip, or any other fastening mechanism. In some cases, inner surface 410 can include a particular feature that locks or engages a conductor, a plug extension member, or both. In still other cases, material used to create a shell member of an interfacing portion can be placed over ring 400 to secure the ring within the plug assembly (e.g., using an overmold).

Figure 5:
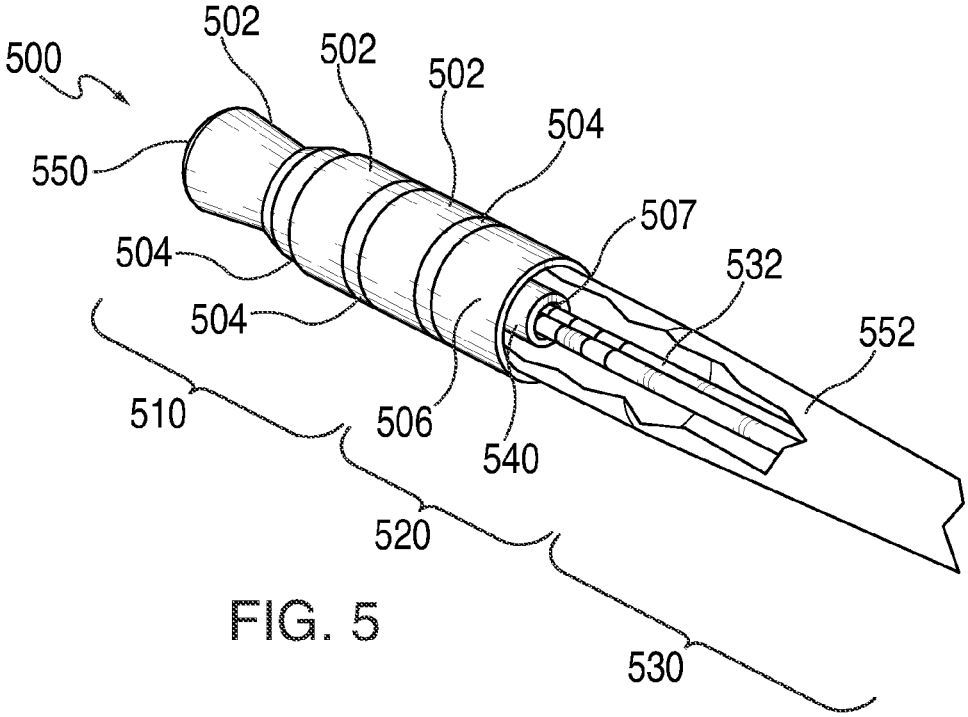
FIG. 5 is a schematic view of an illustrative plug assembly having a final conductive region in accordance with some embodiments of the invention.

Other approaches can be used to add strength to the interface between the conductors and plug portion while maintaining a small profile. In some cases, a final conductive region can be slid over the conductors toward the plug portion to enclose the interface. FIG. 5 is a schematic view of an illustrative plug assembly having a final conductive region in accordance with some embodiments of the invention. Plug assembly 500 can include plug portion 510, interfacing portion 520, and cable portion 530 having some or all of the features of corresponding elements described above. In some cases, plug assembly 500 can include ring 540 placed over an interface between conductors 532 and plug extension members associated with each of conductive regions 502, though ring 540 may not be present.

In addition, plug assembly 500 can include final conductive region 506 provided as a ring that is slid over conductors 532 towards distal end 550 until final conductive region 506 abuts the dielectric ring 504 that is nearest interfacing portion 520 (e.g., the most proximal dielectric ring 504). Conductive region 506 can have an opening 507 through which ring 540 and the interface between plug extension members and conductors 532 can reside without touching conductive region 506. By providing a hard structure surrounding the interface, conductive region 506 can reduce the stress and strain applied to the interface in interfacing portion 520 during use of plug assembly 500.

To conduct signals or power, conductive region 506 can be constructed from any suitable conductive material including, for example, the material used to create conductive regions 502 (e.g., a metal such as brass, silver, gold, or copper). In addition, one of conductors 532 can be connected to conductive region 506 to provide a path through which data and/or power signals can be transferred. Because some conductors 532 are already coupled to the plug extension members of conductive regions 502 when conductive region 506 is assembled to plug assembly 500, it may be difficult to simply solder one more conductor to conductive region 506 within the space enclosed by opening 507. Instead, another approach may be used (e.g., a conductive adhesive, or a surface mount technology process).

Figure 6:
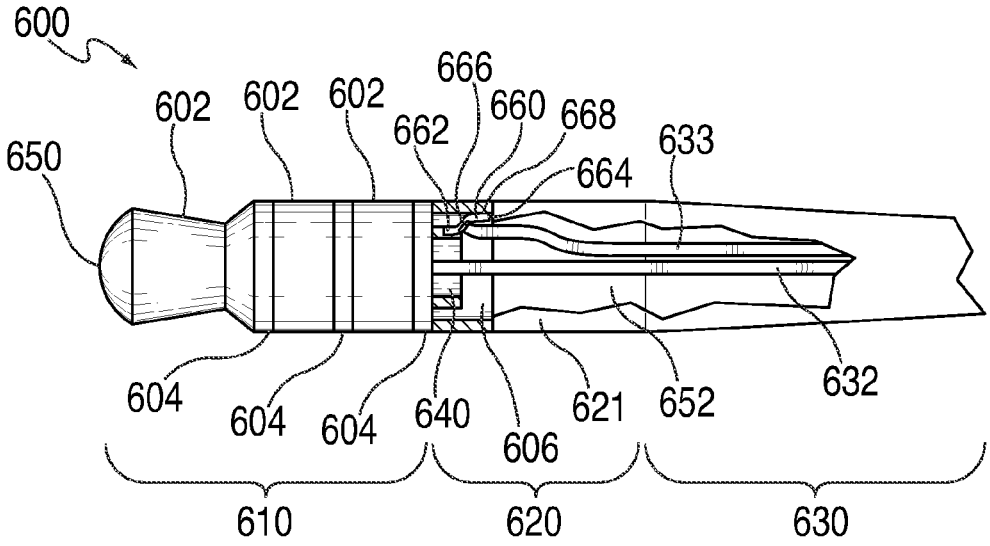
FIG. 6 is a sectional view of a portion of plug assembly having a final conductive region in accordance with some embodiments of the invention.

FIG. 6 is a sectional view of a portion of plug assembly 600 having a final conductive region in accordance with some embodiments of the invention. Plug assembly 600 can include plug portion 610, interfacing portion 620, and cable portion 630 having some or all of the features of corresponding elements described above. Conductors 632 can be coupled to plug extension members (not shown) of conductive regions 602. Ring 640 can be placed over the interface between conductors 632 and conductive regions 602. To complete the plug assembly, final conductive region 606 may be slid over conductors 632 towards tip 650 of plug assembly 600 until conductive region 606 abuts the dielectric ring 604 that is nearest interfacing portion 620 (e.g., furthest from tip 650 of plug portion 610).

Because it may be difficult to couple a conductor to final conductive region 606 once it has been positioned over plug extension members in interfacing region 620, a different approach may be necessary. In particular, it may be beneficial to provide a mechanism by which simply positioning conductive region 606 over the plug extension members causes conductive region 606 to be coupled to a conductor. In some cases, plug assembly 600 can include a conductive spring arm 660 forming a cantilever spring. End 662 of spring arm 660 may be secured, for example in ring 640, such that free end 664 of spring arm may be displaced. Spring 660 can be oriented such that end 662 is distal to end 664 (e.g., the free end of spring arm 660 extends towards cable portion 630). Spring arm 660 can be electrically connected to conductor 633, for example by soldering or surface mount technology at contact pad 666.

Spring arm 660 can be sized and oriented such that end 664 extends away from a centerline of plug assembly 600 and towards an outer surface of the plug assembly. In particular, spring arm 660 can be oriented such that, when it is undeformed, end 664 extends substantially to or beyond the outer diameter of plug portion 610. When conductive region 606 is slid over conductors 632 towards tip 650, an inner surface of conductive region 606 may come into contact with at least end 664 of spring arm 660 and cause end 664 to deflect towards a centerline of plug assembly 600. The elastic deflection of spring arm 660, however, may maintain a portion of spring arm 660 (e.g., contact portion 668) in contact with the inner surface of conductive region 606. This may provide an electrical path from the outside of conductive region 606, through conductive region 606 to the inner surface of the conductive region, into spring arm 660 via contact portion 668, and into conductor 632 via contact pad 666, thus connecting conductive region 606 in plug assembly 600.

Spring arm can be constructed to have any suitable shape. In some cases, the shape can be selected to ensure that a minimum force required to maintain contact with conductive region 606 is applied. In some cases, end 664 may be partially redirected towards the centerline of plug assembly 600 to provide a lip over which conductive region 606 may slide during assembly. The material selected for spring arm 660 can be selected, in combination with the spring arm shape, to tune the force applied to conductive region 606. Spring arm 660 can be constructed from a conductive material, or at least include a conductive path for transferring signals or power between contact region 668 and contact pad 666.

In some cases, spring arm 660 can be retained within ring 640 (e.g., by construction, for example using an overmold, or using an adhesive or other connecting mechanism). Some plug assemblies, however, may not include ring 640. To secure end 662 of spring arm 660, shell member 621 can include two portions, for example two molded shots. A first portion, which can be relatively small, can serve to secure end 662. For example, the first portion can have a shape and dimensions that are similar to ring 640. A second portion, which can be larger than the first portion, can surround at least a portion of the first portion and can define an external surface for interfacing portion 620. In some cases, the second portion can fill some or all of a volume enclosed within conductive region 606.

Different approaches can be used to retain or secure conductive region 606. In some cases, spring arm 660 can apply a large enough force to conductive region 606 that the contact between spring arm 660 and an inner surface of conductive region 606 retains conductive region 606. In some cases, the plug assembly can include one or more additional spring arms distributed around a centerline of plug assembly 600 that apply similar forces to an inner surface of conductive region 606. The additional spring arms may not be used to transfer power or data signals, as spring arm 660 is used for that.

To enhance the coupling between a spring arm and conductive region 606, the inner surface of conductive region 606 can include one or more features operative to engage or receive spring arms. For example, the inner surface can include a receptacle, a tab, a channel, a flange, a hook, or any other feature that can engage a spring arm. In some cases, the spring arm can include a feature that is complimentary to the feature of conductive region 606. The type of features used for a spring arm and the inner surface of conductive region 606 can be selected based on the securing force desired for conductive region 606. For example, features that include hooks, overlapping, or returning features can provide larger region forces than features that include protrusions, flanges, or recesses.

In some cases, material used to form interfacing region 620 can instead or in addition be used to secure conductive region 606 to plug assembly 600. For example, material (e.g., plastic) can be injected into the volume enclosed by conductive region 606 (e.g., as part of a molding process). When the material hardens, it can adhere to ring 640, conductive region 606, and other portions of plug assembly 606 to form a secure conductive region 606. When a material is provided within the volume enclosed by conductive region 606, the material may also maintain spring arm 660 in contact with conductive region 606.

In some cases, conductive region 606 can instead or in addition be secure using other approaches. For example, an adhesive or tape can be used to couple conductive region 606 to a portion of plug assembly 600 (e.g., to a dielectric ring 604). As another example, a mechanical connector, clip, or other connector can be used to secure conductive region 606.

Figure 7:
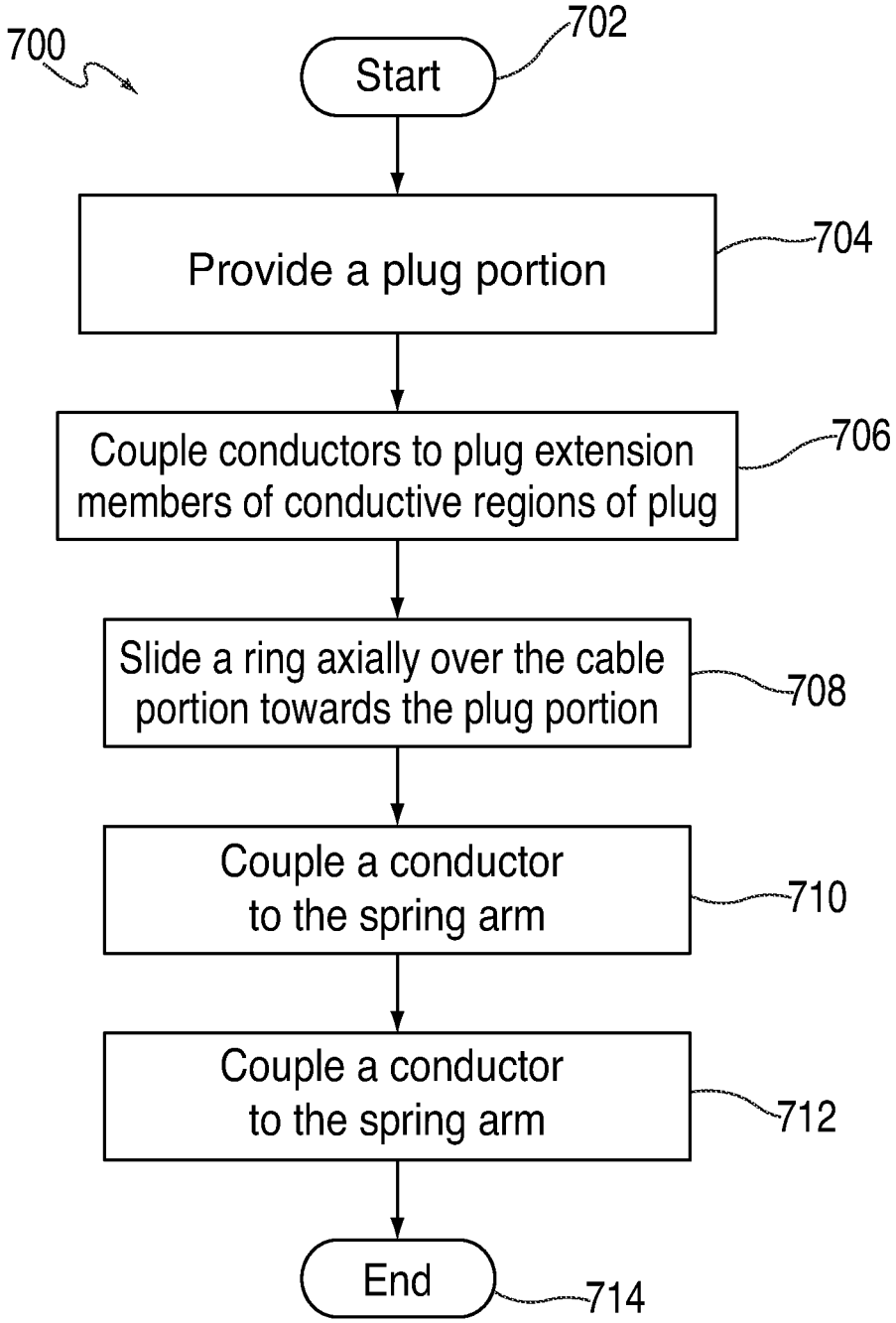
FIG. 7 is a flowchart of an illustrative process for constructing a plug assembly in accordance with some embodiments of the invention.

FIG. 7 is a flowchart of an illustrative process for constructing a plug assembly in accordance with some embodiments of the invention. Process 700 can begin at step 702. At step 704, a plug portion can be provided. In some cases, the plug portion can include several conductive regions, each associated with a plug extension member. At step 706, conductors can be coupled to the plug extension members. In some cases, the conductors can form part of a cable portion. At step 708, a ring can be slide axially over the cable portion towards the plug portion. The ring can abut at least one of the plug extension members. In some cases, the ring can a spring arm extending from the ring towards the cable portion. At step 710, a conductor of the cable bundle can be coupled to the spring arm. For example, the spring arm can include a contact pad to which the conductor can be soldered. At step 712, a final conductive region can be slid over the cable portion towards the plug portion. In some cases, an inner surface of the final conductive region can be placed in contact with the spring arm. Process 700 can end at step 714.

In some cases, a plug assembly as described in embodiments above can be used in a cable structure. For example, the cable structure can interconnect various non-cable components of a headset such as, for example, a plug, headphones, and/or a communications box to provide a headset. The cable structure can include multiple legs (e.g., a main leg, a left leg, and a right leg) that each connect to a non-cable component, and each leg may be connected to each other at a bifurcation region (e.g., a region where the main leg appears to split into the left and right legs). Cable structures according to embodiments of this invention provide aesthetically pleasing interface connections between the non-cable components and legs of the cable structure. The interface connections between a leg and a non-cable component are such that they appear to have been constructed jointly as a single piece, thereby providing a seamless interface. It may be particularly pleasing aesthetically for the plug assembly to have a diameter that is substantially the same as the plug portion in such a cable having a seamless interface.

In addition, because the dimensions of the non-cable components typically have a dimension that is different than the dimensions of a conductor bundle being routed through the legs of the cable structure, one or more legs of the cable structure can have a variable diameter. The change from one dimension to another is accomplished in a manner that maintains the spirit of the seamless interface connection between a leg and the non-cable component throughout the length of the leg. That is, each leg of the cable structure exhibits a substantially smooth surface, including the portion of the leg having a varying diameter. In some embodiments, the portion of the leg varying in diameter may be represented mathematically by a bump function, which requires all aspects of the variable diameter transition to be smooth. In other words, a cross-section of the variable diameter portion can show a curve or a curve profile.

The interconnection of the three legs at the bifurcation region can vary depending on how the cable structure is manufactured. In one approach, the cable structure can be a single-segment unibody cable structure. In this approach, all three legs are jointly formed and no additional processing is required to electrically couple the conductors contained therein. Construction of the single-segment cable may be such that the bifurcation region does not require any additional support. If additional support is required, an over-mold can be used to add strain relief to the bifurcation region.

In another approach, the cable structure can be a multi-segment unibody cable structure. In this approach, the legs may be manufactured as discrete segments, but require additional processing to electrically couple conductors contained therein. The segments can be joined together using a splitter. Many different splitter configurations can be used, and the use of some splitters may be based on the manufacturing process used to create the segment.

The cable structure can include a conductor bundle that extends through some or all of the legs. The conductor bundle can include conductors that interconnect various non-cable components. The conductor bundle can also include one or more rods constructed from a super-elastic material. The super-elastic rods can resist deformation to reduce or prevent tangling of the legs.

Figure 8:
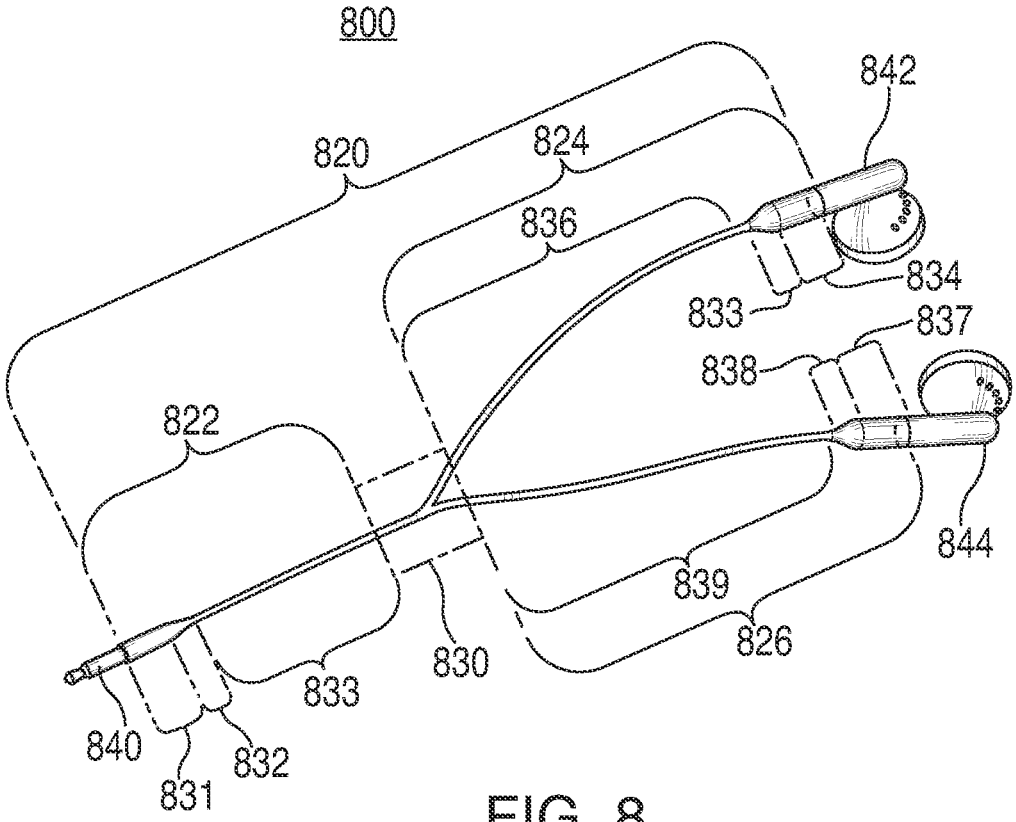
FIG. 8 shows a perspective view of an illustrative headset in accordance with some embodiments of the invention.

FIG. 8 shows an illustrative headset 800 having cable structure 820 that seamlessly integrates with non-cable components 840, 842, and 844. For example, non-cable components 840, 842, and 844 can be a male plug, left headphones, and right headphones, respectively. Cable structure 820 has three legs 822, 824, and 826 joined together at bifurcation region 830. Leg 822 may be referred to herein as main leg 822, and includes the portion of cable structure 820 existing between non-cable component 840 and bifurcation region 830. In particular, main leg 822 includes interface region 831, bump region 832, and non-interface region 833. Leg 824 may be referred to herein as left leg 824, and includes the portion of cable structure 820 existing between non-cable component 842 and bifurcation region 830. Leg 826 may be referred to herein as right leg 826, and includes the portion of cable structure 820 existing between non-cable component 844 and bifurcation region 830. Both left and right legs 824 and 826 include respective interface regions 834 and 837, bump regions 835 and 838, and non-interface regions 836 and 839.

Legs 822, 824, and 826 generally exhibit a smooth surface throughout the entirety of their respective lengths. Each of legs 822, 824, and 826 can vary in diameter, yet still retain the smooth surface.

Non-interface regions 833, 836, and 839 can each have a predetermined diameter and length. The diameter of non-interface region 833 (of main leg 822) may be larger than or the same as the diameters of non-interface regions 836 and 839 (of left leg 824 and right leg 826, respectively). For example, leg 822 may contain a conductor bundle for both left and right legs 824 and 826 and may therefore require a greater diameter to accommodate all conductors. In some embodiments, it is desirable to manufacture non-interface regions 833, 836, and 839 to have the smallest diameter possible, for aesthetic reasons. As a result, the diameter of non-interface regions 833, 836, and 839 can be smaller than the diameter of any non-cable component (e.g., non-cable components 840, 842, and 844) physically connected to the interfacing region. Since it is desirable for cable structure 820 to seamlessly integrate with the non-cable components, the legs may vary in diameter from the non-interfacing region to the interfacing region.

Bump regions 832, 835, and 838 provide a diameter changing transition between interfacing regions 831, 834, and 837 and respective non-interfacing regions 833, 836, and 839. The diameter changing transition can take any suitable shape that exhibits a fluid or smooth transition from any interface region to its respective non-interface region. For example, the shape of the bump region can be similar to that of a cone or a neck of a wine bottle. As another example, the shape of the taper region can be stepless (i.e., there is no abrupt or dramatic step change in diameter, or no sharp angle at an end of the bump region). Bump regions 832, 835, and 838 may be mathematically represented by a bump function, which requires the entire diameter changing transition to be stepless and smooth (e.g., the bump function is continuously differentiable).

Interface regions 821, 834, and 837 can each have a predetermined diameter and length. The diameter of any interface region can be substantially the same as the diameter of the non-cable component it is physically connected to, to provide an aesthetically pleasing seamless integration. For example, the diameter of interface region 821 can be substantially the same as the diameter of non-cable component 840. In some embodiments, the diameter of a non-cable component (e.g., component 840) and its associated interfacing region (e.g., region 831) are greater than the diameter of the non-interface region (e.g., region 833) they are connected to via the bump region (e.g., region 832). Consequently, in this embodiment, the bump region decreases in diameter from the interface region to the non-interface region.

In another embodiment, the diameter of a non-cable component (e.g., component 840) and its associated interfacing region (e.g., region 831) are less than the diameter of the non-interface region (e.g., region 833) they are connected to via the bump region (e.g., region 832). Consequently, in this embodiment, the bump region increases in diameter from the interface region to the non-interface region.

The combination of the interface and bump regions can provide strain relief for those regions of headset 810. In one embodiment, strain relief may be realized because the interface and bump regions have larger dimensions than the non-interface region and thus are more robust. These larger dimensions may also ensure that non-cable portions are securely connected to cable structure 820. Moreover, the extra girth better enables the interface and bump regions to withstand bend stresses.

The interconnection of legs 822, 824, and 826 at bifurcation region 830 can vary depending on how cable structure 820 is manufactured. In one approach, cable structure 820 can be a jointly formed multi-leg or single-segment unibody cable structure. In this approach all three legs are manufactured jointly as one continuous structure and no additional processing is required to electrically couple the conductors contained therein. That is, none of the legs are spliced to interconnect conductors at bifurcation region 830, nor are the legs manufactured separately and then later joined together. Some jointly formed multi-leg cable structures may have a top half and a bottom half, which are molded together and extend throughout the entire cable structure. Thus, although a mold-derived jointly formed multi-leg cable structure has two components (i.e., the top and bottom halves), it is considered a jointly formed multi-leg cable structure for the purposes of this disclosure. Other jointly formed multi-leg cable structures may exhibit a contiguous ring of material that extends throughout the entire cable structure.

In another approach, cable structure 820 can be a multi-segment unibody cable structure in which three discrete or independently formed legs are connected at a bifurcation region. A multi-segment unibody cable structure may have the same appearance of the jointly formed multi-leg cable structure, but the legs are manufactured as discrete components. The legs and any conductors contained therein are interconnected at bifurcation region 830. The legs can be manufactured, for example, using any of the processes used to manufacture the jointly formed multi-leg cable structure.

The cosmetics of bifurcation region 830 can be any suitable shape. In one embodiment, bifurcation region 830 can be an overmold structure that encapsulates a portion of each leg 822, 824, and 826. The overmold structure can be visually and tactically distinct from legs 822, 824, and 826. The overmold structure can be applied to the single or multi-segment unibody cable structure. In another embodiment, bifurcation region 830 can be a two-shot injection molded splitter having the same dimensions as the portion of the legs being joined together. Thus, when the legs are joined together with the splitter mold, cable structure 820 maintains its unibody aesthetics. That is, a multi-segment cable structure has the look and feel of jointly formed multi-leg cable structure even though it has three discretely manufactured legs joined together at bifurcation region 830. Many different splitter configurations can be used, and the use of some splitters may be based on the manufacturing process used to create the segment.

Cable structure 820 can include a conductor bundle that extends through some or all of legs 822, 824, and 826. Cable structure 820 can include conductors for carrying signals from non-cable component 840 to non-cable components 842 and 844. Cable structure 820 can include one or more rods constructed from a super-elastic material. The rods can resist deformation to reduce or prevent tangling of the legs. The rods are different than the conductors used to convey signals from non-cable component 840 to non-cable components 842 and 844, but share the same space within cable structure 820. Several different rod arrangements may be included in cable structure 820.

In yet another embodiment, one or more of legs 822, 824, and 826 can vary in diameter in two or more bump regions. For example, the leg 822 can include bump region 832 and another bump region (not shown) that exists at leg/bifurcation region 830. This other bump region may vary the diameter of leg 822 so that it changes in size to match the diameter of cable structure at bifurcation region 830. This other bump region can provide additional strain relief. Each leg can have any suitable diameter including, for example, a diameter in the range of 0.4 mm to 1 mm (e.g., 0.8 mm for leg 820, and 0.6 mm for legs 822 and 824).

The previously described embodiments are presented for purposes of illustration and not of limitation. It is understood that one or more features of an embodiment can be combined with one or more features of another embodiment to provide systems and/or methods without deviating from the spirit and scope of the invention.

What is claimed is:

1. A plug assembly comprising:

a cable portion comprising a plurality of conductors;

a plug portion comprising a plurality of conductive regions each associated with a plug extension member, wherein each of the plug extension members is coupled to one of the plurality of conductors; and an interfacing portion between the cable portion and the plug portion at which each of the plurality of conductive regions is coupled to one of the plurality of conductors via the plug extension members, the interfacing portion comprising:

a ring positioned around at least one plug extension member and the one of the plurality of conductors coupled to the at least one plug extension member; and a shell member that encompasses the ring to form an exterior surface of the plug assembly, wherein a diameter of the shell member is substantially the same as a diameter of at least one of the conductive regions.

2. The plug assembly of claim 1, wherein the plug portion further comprises:

a plurality of dielectric rings separating each of the plurality of conductive regions.

3. The plug assembly of claim 1, wherein:

the ring is secured to at least one conductor and to at least one plug extension member.

4. The plug assembly of claim 1, wherein:

the ring is constructed from a dielectric material.

5. The plug assembly of claim 1, the interfacing portion further comprising:

a spring arm having a secured end and a free end, the spring arm in contact with an inner surface of one of the plurality of conductive regions.

6. The plug assembly of claim 5, wherein:

the one of the plurality of conductive regions comprises the conductive region nearest the interfacing portion.

7. The plug assembly of claim 5, wherein:

the secured end of the spring arm is adjacent to the plug portion; and the free end of the spring arm is adjacent to the cable portion.

8. The plug assembly of claim 5, wherein:

one of the plurality of conductors is coupled to the spring arm.

9. The plug assembly of claim 5, wherein:

the spring arm is constructed from a conductive material.

10. The plug assembly of claim 5, wherein:

the secured end of the spring arm is secured within the ring.

* * * * *